US007318794B2

(12) United States Patent
Davies

(10) Patent No.: US 7,318,794 B2
(45) Date of Patent: Jan. 15, 2008

(54) YOGA BLOCKS

(76) Inventor: Keith Davies, 685 78th Ave. #2, San Francisco, CA (US) 94121

( * ) Notice: Subject to any disclaimer, the term of this patent is extended or adjusted under 35 U.S.C. 154(b) by 41 days.

(21) Appl. No.: 11/328,557

(22) Filed: Jan. 10, 2006

(65) Prior Publication Data

US 2007/0161476 A1 Jul. 12, 2007

(51) Int. Cl.
*A63B 26/00* (2006.01)

(52) U.S. Cl. ..... 482/142; 446/85

(58) Field of Classification Search ..... 482/142; 446/85; D21/484; 434/403, 208, 167; 84/476
See application file for complete search history.

(56) References Cited

U.S. PATENT DOCUMENTS 3,662,486 A * 5/1972 Freedman ..... 446/120
4,326,354 A * 4/1982 Hagberg ..... 446/126

* cited by examiner

*Primary Examiner*—Lori Amerson
(74) *Attorney, Agent, or Firm*—Dergosits & Noah LLP

(57) ABSTRACT

A yoga block system which includes a first block and a second block which can either be rectangularly shaped or triangularly shaped. These blocks are capable of joining with one another, releaseably, along either a common face when the blocks are rectangular or along the hypotenuses when the blocks are triangularly shaped. At least one of these blocks is preferably hollow enabling a user to gain access to its interior. Notwithstanding the elements used to join them, each block presents to a user faces which remain substantially planar.

14 Claims, 3 Drawing Sheets

YOGA BLOCKS

TECHNICAL FIELD

The present invention deals, generally, with yoga blocks which are extensively used by those engaged in yoga. The blocks of the present invention provide an extremely convenient structural arrangement making such blocks much easier to use and to transport than those which have previously existed.

BACKGROUND OF THE INVENTION

Those who practice yoga employ blocks in order to support a number of established positions. Without such blocks, it would be very difficult to take full advantage of the benefits that yoga exercise can provide. These blocks are generally rectangular or brick shaped or, alternatively, triangularly shaped.

Yoga blocks are generally used in pairs as they are employed by each hand or by each foot of a user. The blocks can be of equal size or can be of different sizes depending upon the yoga exercise being performed and the yoga position being maintained.

When traveling to and from an exercise class, a participant generally must transport a number of items, some of which are difficult to secure during exercise. For example, two blocks are carried together with such items as a Pilate strap, clothing items, keys, watches and other personal items which, again, must be stored during exercise. The present invention is intended to simplify this matter and provide yoga blocks which are much easier to carry and significantly more user friendly than those currently available.

It is thus an object of the present invention to provide yoga blocks which are improved over those currently being employed.

These and further objects will be more readily appreciated when considering the following disclosure and appended claims.

SUMMARY OF THE INVENTION

The present invention involves a yoga block system. In a first embodiment, the yoga block system comprises a first block and a second block each of which being of a rectangular shape having a number of planar faces wherein a first face of said first block and a first face of said second block are releaseably joined to one another wherein further said first face of said first block and said first face of said second block remain substantially planar notwithstanding their being provided with joining means configured therein.

In a second embodiment, the yoga block system comprises a first block and second block, each of which having a triangular cross section with two perpendicular edges and a hypotenuse wherein the hypotenuse of the first block and the hypotenuse of the second block are releaseably joined to one another wherein, further, said hypotenuse of said first block and said hypotenuse of said second block remain substantially planar notwithstanding their being provided with joining means configured therein.

Ideally, at least one of the blocks is hollow and selective access is provided to its interior to enable one to store items which otherwise would be difficult to secure during exercise.

DETAILED DESCRIPTION OF THE INVENTION

Figure 1A:
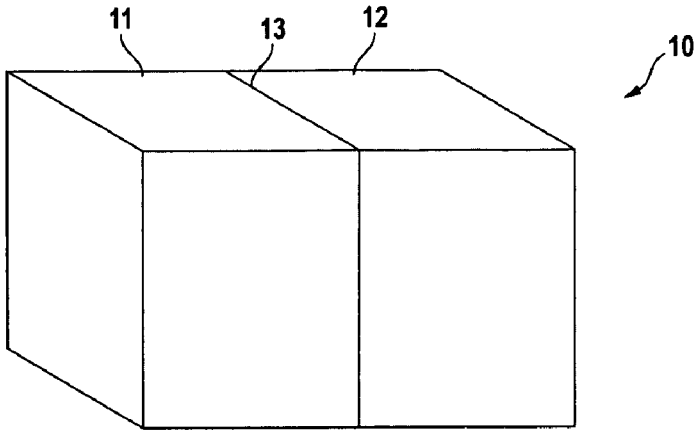
FIGS. 1A and 1B represent perspective views of two embodiments of the present invention.

As noted previously, the present invention involves a yoga block system. In this regard, reference is first made to FIG. 1A showing a first block 11 and a second block 12 each of which being of rectangular shape and having a number of planar faces. Said planar faces can comprise faces 23-24 (FIG. 2A) or 33-34 (FIG. 2C). These planar faces, when rectangular blocks 11 and 12 are joined, abut one another at seam 13.

Figure 1B:
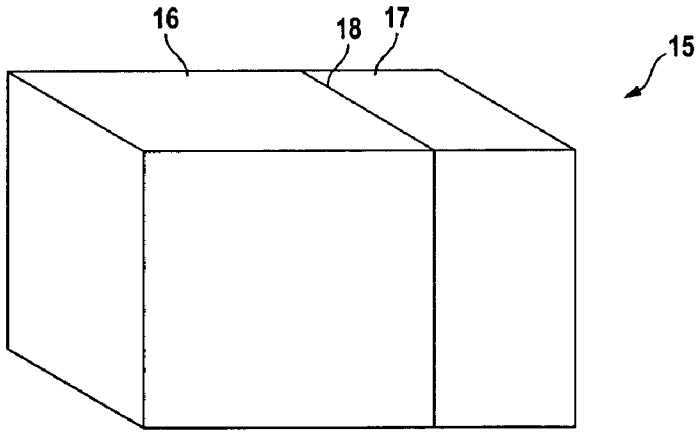

The embodiment of FIG. 1A shows blocks 11 and 12 being of the same size and dimension. This is most convenient for when blocks 11 and 12 are released from contact with one another, these blocks will present the same dimension to a yoga participant. However, there are times when one would wish to have blocks of differing dimension. In this regard, reference is made to FIG. 1B wherein yoga block system 15 is shown comprised of smaller block 17 and larger block 16 joined at common seam 18.

Regardless of whether one employs yoga block system 10 or 15, it is the intent of the present invention to enable one to selectively and releaseably join blocks. In doing so, a yoga participant can travel to a participating location with a single block system comprised of two joined blocks rather than to juggle separate blocks in transit.

Figure 2A:
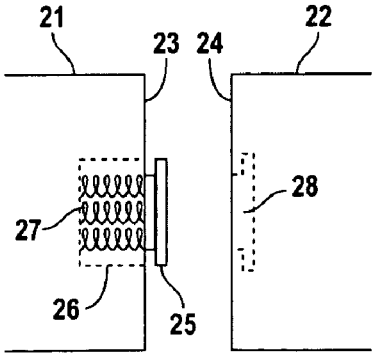
FIG. 2A is a side partial view of one embodiment of the present invention.
Figure 2B:
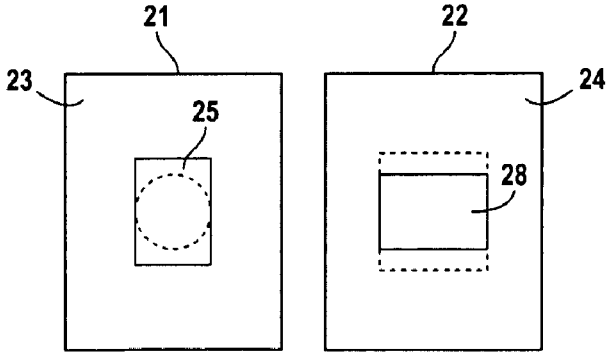
FIG. 2B is a side plan view of the embodiment of the present invention shown in FIG. 2A.
Figure 2C:
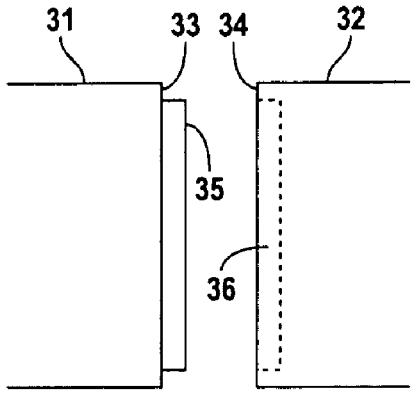
FIG. 2C is a side partial view of a second embodiment of the present invention.

FIGS. 2A and 2B depict a first embodiment for releaseably joining blocks to one another. Turning first to FIG. 2A, first face 23 of first block 21 is releaseably joined to first face 24 of block 22. In this embodiment, first face 23 is configured with a hollowed portion 26 housing springs 27 which support tongue 25. First face 24 of second block 22 is provided with key portion 28. In use, tongue 25 is inserted within key portion 28 and, thereupon, block 21 is rotated 90 degrees with respect to block 22. Blocks 21 and 22 are thus in a releasably joined condition. Blocks 21 and 22 will not disengage until they are rotated 90 degrees with respect to one another enabling tongue 25 to release from keyhole slot 28.

The combination of hollowed portion 26 housing springs 27 supporting tongue 24 and key portion 28 enables the first face of first block 21 and first face of second block 22 to remain planar to one another notwithstanding them being joined.

Noting that it is an important element of the present invention to enable the various blocks to be used during exercise, it is necessary for tongue 25 to withdraw within the body of block 21 in order to present a planar surface 23 to, for example, a supporting floor employed during exercise. In this regard, reference is made to FIG. 2E showing that when block 21 is placed upon floor 5, tongue 25 is pressed within cut out portion 26 by compression of springs 27. Thus, although block 21 is provided with a means of engaging and releaseably joining with a companion block, in use, the expedient use for joining does not represent an impediment in the use of block 21 for exercise.

Figure 2D:
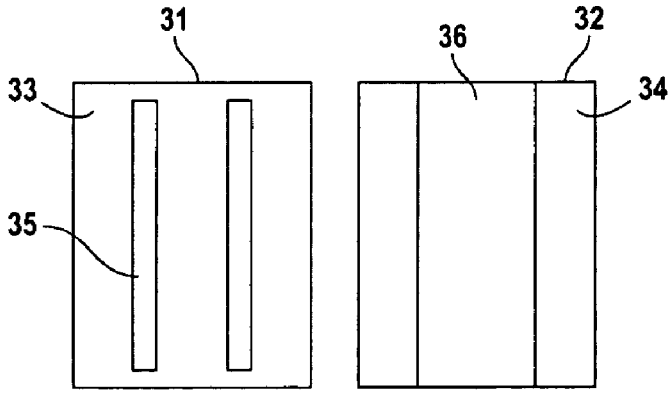
FIG. 2D is a side plan view of the embodiment of the present invention shown in FIG. 2C.
Figure 2E:
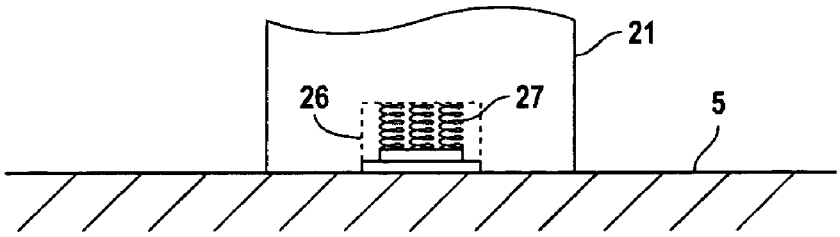
FIG. 2E is a side partial view of the embodiment of the present invention shown in FIG. 2A.

Yet a second embodiment is shown in FIGS. 2C and 2D. In this regard, rail 35 is provided upon planar surface 33 of block 31 and a suitable channel 36 is provided within planar surface 34 of block 32. In use, block 31 would simply slide upon block 32 whereby rails 35 would releaseably engage channel 36. When disengagement is sought, blocks 31 and 32 would merely be slid away from one another disengaging rails 35 from channel 36. When used for exercise, rails 35 would again present a substantially planar surface thus not interfering with a yoga exercise program employing this block. The combination of rail 35 upon surface 33 of block 31 and channel 36 within surface 34 of block 32 enables surfaces 33 and 34 to remain planar to one another notwithstanding their being joined.

Figure 3:
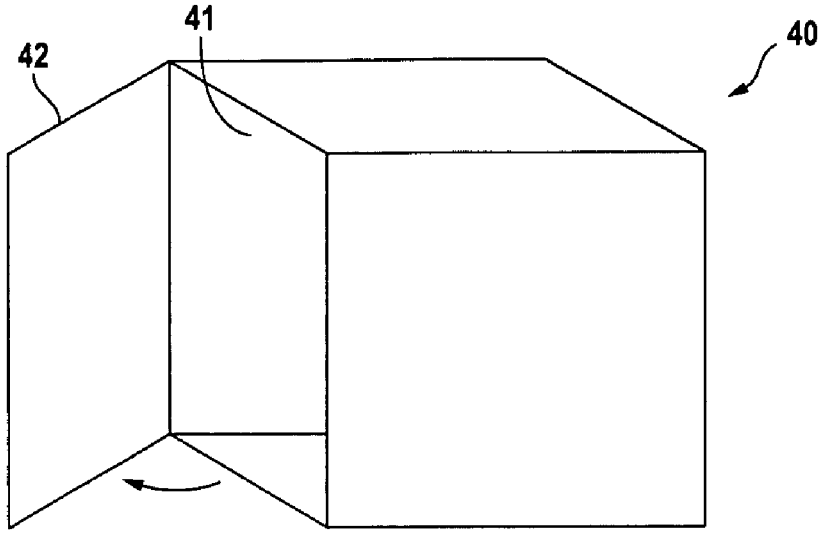
FIG. 3 is a perspective view yet a further embodiment of the present invention.

As a further expedient, reference is made to FIG. 3 wherein at least one of the first or second blocks 40 is depicted as having a hollow interior 41 noting that at least one of the planar faces 42 is removable to provide access to interior 41. As noted previously, those engaging in yoga exercise often find the need to store valuable items such as Pilate straps, yoga belts, keys, wallets, shoes and other articles of clothing and finding a secure and safe place to park such items as proven problematic. The yoga block system of the present invention by providing at least one of the blocks as a hollow member addresses this issue.

Figure 4:
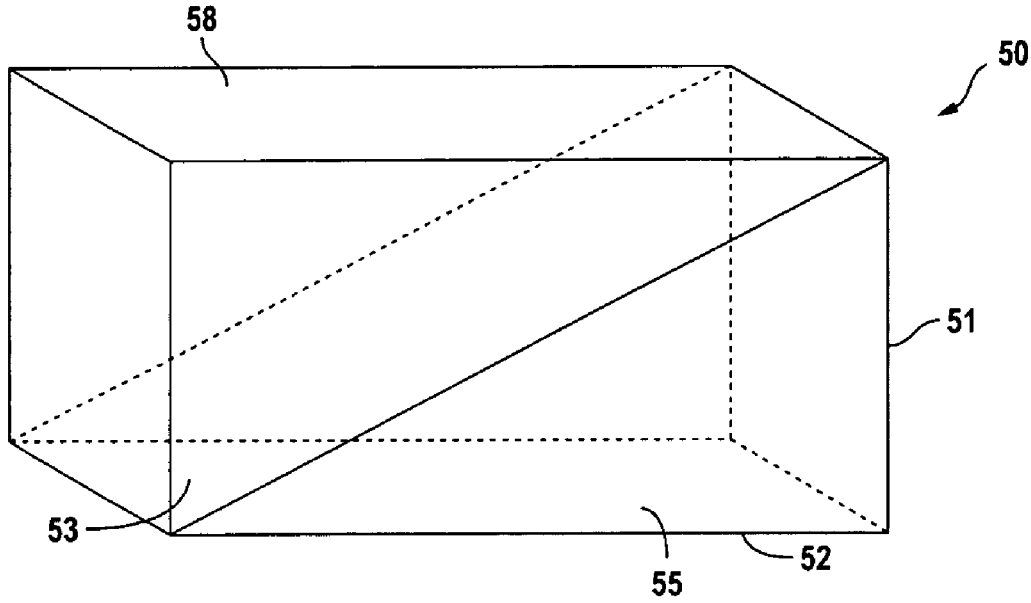
FIG. 4 is a perspective view of the embodiment of the present invention wherein the blocks are shown as being triangularly shaped rather than rectangularly shaped as was the case with FIGS. 1A and 1B.

Although the discussion as provided above has focused upon a yoga block system in which the first and second blocks are rectangularly shaped, recognizing that yoga enthusiasts also oftentimes have need for triangular or wedge-shaped blocks, reference is made to FIG. 4. FIG. 4 depicts a yoga block system 50 comprising a first block 55 and a second block 58, each of which having a triangular cross section with two perpendicular edges 51 and 52 and a hypotenuse 53. As noted in FIG. 4, the hypotenuse of first block 55 and the hypotenuse of second block 58 are joined to one another to provide an overall rectangular shaped block. Although not shown in FIG. 4, each of blocks 55 and 58 can be releaseably joined to one another employing the various expedients shown in FIGS. 2A through 2E herein. In doing so, blocks 55 and 58 are releaseably joined and, when released from one another, each hypotenuse remains substantially planar notwithstanding that they are provided with joining means configured therein. Again, this was well discussed previously with regard to FIG. 2 and the physical configuration disclosed therein is most applicable to the embodiment of FIG. 4. Further, one of blocks 55 and/or 58 can have a hollow interior enabling one to use one or both blocks for storage during exercise.

The invention claimed is:

1. A yoga block system comprising a first block and a second block each of which being of a rectangular shape having a number of planar faces wherein a first face of said first block and a first face of said second block are releasably joined to one another wherein further said first face of said first block and said first face of said second block remain substantially planar notwithstanding their being provided with joining means configured therein.

2. The yoga block system of claim 1 wherein at least one of said first block or said second block is hollow and at least one of said planar faces is removable to provide access to the interior of at least one of said first block or said second block.

3. The yoga block system of claim 1 wherein said first face of said first block is provided with a tongue biased to extend beyond said first face but is configured to lay flush with said first face when said first face is pressed against a planar surface.

4. The yoga block system of claim 3 wherein said first face of said second block is provided with a key channel for releasably receiving said tongue for releasably joining said first block to said second block.

5. The yoga block system of claim 1 wherein said first face of said first block is provided with two parallel rails and said first face of said second block is provided with a channel sized to receive said rails in sliding engagement for releasably joining said first block to said second block.

6. The yoga block system of claim 1 wherein said first block and said second block are of substantially the same size.

7. The yoga block system of claim 1 wherein said first block and said second block are of different sizes.

8. A yoga block system comprising a first block and a second block, each of which having a triangular crossection with two perpendicular edges and a hypotenuse, wherein the hypotenuse of said first block and the hypotenuse of said second block are releasably joined to one another wherein further said hypotenuse of said first block and said hypotenuse of said second block remain substantially planar notwithstanding there being provided with joining means configured therein.

9. The yoga block system of claim 8 wherein at least one of said first block or second block is hollow and at least one of said blocks further comprises a removable face to provide access to the interior of at least one of said first block or second block.

10. The yoga block system of claim 8 wherein said hypotenuse of said first block and the hypotenuse of said second block are releaseably joined to one another by providing a tongue biased to extend beyond said hypotenuse of said first block but is configured to lay flush with said hypotenuse of said first block when said hypotenuse of said first block is pressed against a planar surface.

11. The yoga block system of claim 10 wherein said hypotenuse of said second block is provided with a key channel for releaseably receiving said tongue for releaseably joining said first block to said second block.

12. The yoga block system of claim 8 wherein said hypotenuse of said first block is provided with two parallel rails and said hypotenuse of said second block is provided with a channel sized to receive said rails in a sliding engagement for releasably joining said first block to said second block.

13. The yoga block system of claim 8 wherein said first block and said second block are substantially the same size.

14. The yoga block system of claim 8 wherein said first block and said second block are of different sizes.

* * * * *